United States Patent [19]

Pfeil et al.

[11] 4,119,016

[45] Oct. 10, 1978

[54] HYDRAULIC CONTROL DEVICE

[75] Inventors: Christian Pfeil, Neuss, Rhein; Hans Breidenbach, Delrath, both of Fed. Rep. of Germany

[73] Assignee: International Harvester Company, Chicago, Ill.

[21] Appl. No.: 701,475

[22] Filed: Jul. 1, 1976

[30] Foreign Application Priority Data

Jul. 24, 1975 [DE] Fed. Rep. of Germany ..... 2533164

[51] Int. Cl.[2] ..... F15B 11/08; F15B 13/042

[52] U.S. Cl. ..... 91/449; 91/461; 60/468; 60/494; 137/389; 137/399; 137/413; 417/211.5; 417/299; 417/309

[58] Field of Search ..... 417/211.5, 309, 307, 417/299; 137/399, 389, 413; 60/403, 468, 494; 91/442, 268, 461, 304, 452, 449, 438, 450

[56] References Cited

U.S. PATENT DOCUMENTS

| | | | |
|---|---|---|---|
| 701,548 | 6/1902 | Day | 137/398 X |
| 993,628 | 5/1911 | Williams | 137/413 |
| 2,317,091 | 4/1943 | Adams | 137/399 |
| 3,292,500 | 12/1966 | Risk | 91/449 |
| 3,335,746 | 8/1967 | Lebow | 137/389 |
| 3,723,025 | 3/1973 | Caokley | 417/299 |

FOREIGN PATENT DOCUMENTS

| | | | |
|---|---|---|---|
| 1,186,504 | 2/1959 | France | 417/299 |
| 378,164 | 7/1964 | Switzerland. | |

*Primary Examiner*—Irwin C. Cohen

*Attorney, Agent, or Firm*—Raymond E. Parks; Frederick J. Krubel; F. David AuBuchon

[57] ABSTRACT

A hydraulic control device for use in a hydraulic system having a pump supplying fluid from a reservoir to a working circuit. The control device detects leaks in the working circuit by monitoring the level of hydraulic fluid in the reservoir. In the event of a drop in the level of hydraulic fluid beyond a predetermined low level, the control device automatically diverts the fluid output side of the pump to the fluid input side to prevent further loss of fluid in the working circuit and to safeguard against cavitation in the pump due to the low level of fluid in the reservoir. The control device also senses excessive pressure peaks in the working circuit and operates to relieve the excessive pressure peaks by automatically venting a portion of the fluid on the output side of the pump to the reservoir.

1 Claim, 3 Drawing Figures

HYDRAULIC CONTROL DEVICE

BACKGROUND OF THE INVENTION

This invention relates to a hydraulic control device for a hydraulic system having a working circuit with a consumer or hydraulic actuator unit, a hydraulic fluid source, and a hydraulic fluid reservoir.

FIELD OF THE INVENTION

Hydraulic systems are utilized on a variety of applications. In all cases the hydraulic systems must be safeguarded against the developing of adverse operating conditions. Often hydraulic systems are safeguarded against excessive pressure by the installation of a safety or relief valve at the pressure or delivery side of the hydraulic fluid source. However, hydraulic systems must not only be safeguarded against excessive pressure, but also against loss of hydraulic fluid in the event of a line failure somewhere in the hydraulic system; and in the case of where the system is low on fluid in the reservoir.

SUMMARY OF THE INVENTION

This invention is based on the objective of providing a hydraulic control device in a hydraulic system having a working circuit with a consumer or hydraulic actuator unit, a hydraulic fluid source, and a reservoir holding hydraulic fluid; whereby by simple means of design, the control device safeguards the system in the best possible manner against both the lack of hydraulic fluid and excessive hydraulic pressure. According to the invention this problem is solved by providing a fluid level regulating float valve which opens and closes in a manner functionally related to the fluid level in the fluid reservoir, and by providing a pressure relief valve arranged at the delivery side of the hydraulic fluid source. A first control chamber in the pressure relief valve is connected to the delivery side of the hydraulic fluid source by means of a first control line equipped with a pressure regulating valve. The pressure regulating valve is connected to the fluid level regulating float valve by means of a second control line. With the fluid level regulating float valve in an open position, the pressure relief valve takes up a position where, by means of a short-circuit line, the delivery or pressure side of the hydraulic fluid source is connected to the suction or low pressure side of the hydraulic fluid source.

By applying the means described in this invention, a hydraulic control device is provided by which the hydraulic system is adequately safeguarded by very few simple structural elements. This protective system not only reacts to a lack or low level of hydraulic fluid in the hydraulic fluid reservoir, but also in the situation where, during operation of the hydraulic system a leak develops or there is a line failure, or similar occurrence which causes a loss of hydraulic fluid in the working circuit or hydraulic system. In such cases the delivery or fluid output side of the hydraulic fluid source or pump is short-circuited to the fluid input or low pressure suction side by means of the short-circuit line, so that the remaining hydraulic fluid in the system is saved and any start-up operation or any continued operation is rendered impossible until the cause of the loss is found and corrected and the lost fluid is replenished.

Because of the steady flow of hydraulic fluid, via the short-circuit line, the operation of the hydraulic fluid source or hydraulic pump without hydraulic fluid is prevented thus preventing cavitation in the hydraulic pump due to the low level of fluid in the reservoir.

Furthermore, the safety control device featured in this invention offers the advantage of the consumer or working circuit being separable from the supply circuit comprising the fluid delivery or output side of the pump, the suction or fluid input side of the pump, and the short-circuit line between the output and input sides, so that repairs can be carried out without difficulty in the separated consumer or working circuit without having to stop the entire operation of the hydraulic system. Such a feature is highly desirable on large-scale hydraulic systems.

Another feature of the invention, provides that short-circuit line or connection between the delivery or fluid output side and the suction or fluid input side of the hydraulic fluid source or pump has an adjustable flow rate which is selected by a variable flow valve in the short-circuit line. By means of such an adjustable flow rate valve, the hydraulic control device can easily be adapted to fit a variety of hydraulic power systems. This can be done by simply providing an axially movable stop pin in the housing of the pressure relief valve to adjust the flow area in the connecting conduit or line between the fluid delivery or output side and the suction or fluid intake side of the hydraulic fluid source or pump. The stop pin can be employed to limit the stroke or linear path of a spool valve means arranged in the valve housing in an axially movable manner.

A further feature of the invention, is in the fluid level regulating float valve. The float valve has a reciprocating spool member which is connected at one end to a float arm member by means of a lever-bar. Preferably the float member, which is carried on the swingable end of the arm member, is adjustable along the length of the arm member to select a fluid level in the reservoir at which the spool member opens and closes. Preferably the spool member is designed to be axially movable in a bore in a float valve housing which is flanged to the fluid reservoir. A tapered or truncated conical control surface is provided at a second end of the spool member which seats on an annular opening in the valve housing communicating to the reservoir. An annular surface is provided, which is adjacent the tapered control face or surface and is located within a chamber communicating with the annular opening or valve seat in the float valve housing. The chamber is connected to a second control line. By means of the annular surface and a portion of the tapered control surface within the chamber, the regulating float valve also functions as a relief valve for excessive fluid pressure in the second control line. The excessive pressure acting upon the annular surface and tapered control surface of the spool member will be of a magnitude greater than the force originating from the buoyancy of the float member on the fluid in the reservoir. Thus the excessive pressure will shift the spool member from the valve seat to an open position communicating the second control line with the reservoir. By this means temporary excessive peak pressures at the fluid output or pressure side of the hydraulic fluid source or pump can be diminished. However, with excessive pressure lasting over a prolonged period of time, as an additional safety measure, the spool valve means in the pressure relief valve is moved to the aforementioned short-circuiting position, thus also guarding against any prolonged periods of overloading of the hydraulic fluid source.

DESCRIPTION OF THE DRAWING

A preferred embodiment according to the invention is pictured in the various figures of the drawing and is described in detail as follows.

DESCRIPTION OF THE PREFERRED EMBODIMENT

Figure 1:
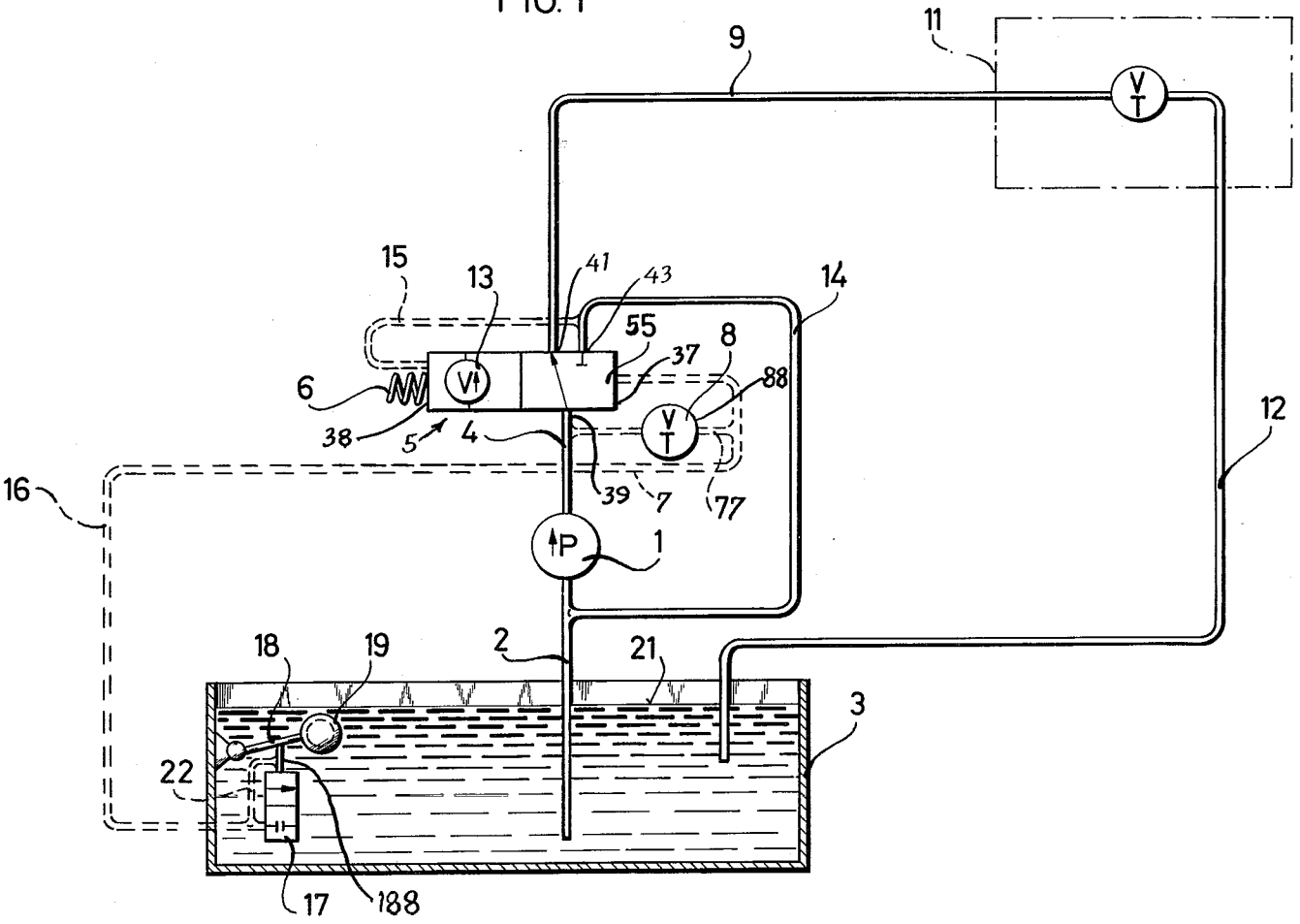
FIG. 1 is a schematic of a hydraulic power system incorporating a preferred embodiment of a hydraulic control device according to the invention.
Figure 3:
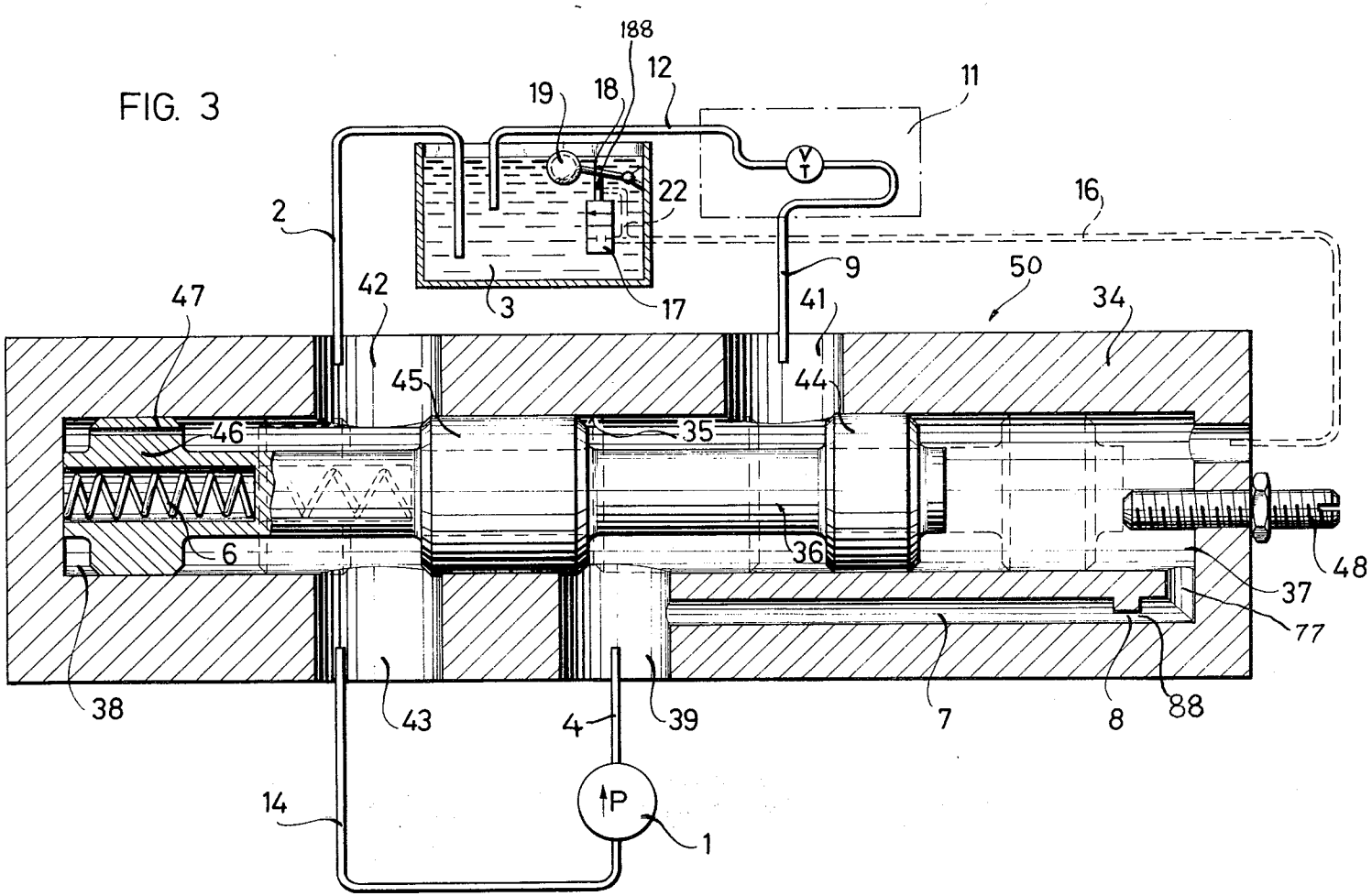
FIG. 3 is an enlarged cross-sectional detail of a pressure regulating valve incorporated in a modified version of the hydraulic power system shown in FIG. 1.

With reference to FIGS. 1 and 3, a typical hydraulic power system generally comprises a hydraulic fluid source 1, which is represented by the pump P, and includes a hydraulic fluid reservoir 3, a fluid intake or suction line 2 which extends into the reservoir to a predetermined depth which is above the floor of the reservoir, a fluid output or pressure line 4, and a working circuit which includes high pressure line 9, a hydraulic activator 11 with consumer unit VT and a fluid return line 12.

According to the invention, with reference to FIG. 1, there is provided in the hydraulic power system, a pressure relief or two position fluid flow diverter valve 5 which has a fluid inlet port 39 connected in line 4 to the fluid output or pressure or delivery side of the pump 1. One side 38 of the pressure relief valve 5 is spring-biased by a compression spring 6. The opposite side 37 is in fluid communication with the fluid output line 4 by means of a first control line 77. A pressure regulating valve or restrictor 8 is connected in the upstream side 7 of the first control line 77 and establishes a predetermined pressure in line 77 at the aforesaid opposite side 37 of the pressure relief valve 5 which is sufficient to overcome the force of the compression spring 6 to maintain the spool valve or flow control means 55 in the leftward position shown in FIG. 1. In the leftward position shown in FIG. 1, the spool valve means 55 establishes a fluid connection through feed port 41 between the fluid output line 4 and the feed line 9 of the working circuit. The feed line 9 is connected at one end to feed port 41 and at the opposite end to any known suitable hydraulic actuator or consumer 11. A fluid discharge or return line 12 discharges fluid from the actuator 11 into the reservoir 3.

An adjustable flow rate regulating valve means 13 is incorporated in the spool valve means 55 which is set to deliver a predetermined quantity of fluid from the fluid output line 4 into the fluid input line 2 through a short-circuit or second feed line 14 upon the rightward shifting of the spool valve means 55 from the leftward position shown in FIG. 1. The short-circuit line 14 is connected at one end to discharge port 43 of the pressure relief valve 5 and at the opposite end to the fluid input line 2 or suction side of the source 1. A drain line 15 is provided to drain off any fluid trapped behind the spring end side of the spool valve means 55. One end of the drain line 15 is connected to the spring end side 38 and the opposite end is connected to the short-circuit line 14.

Figure 2:
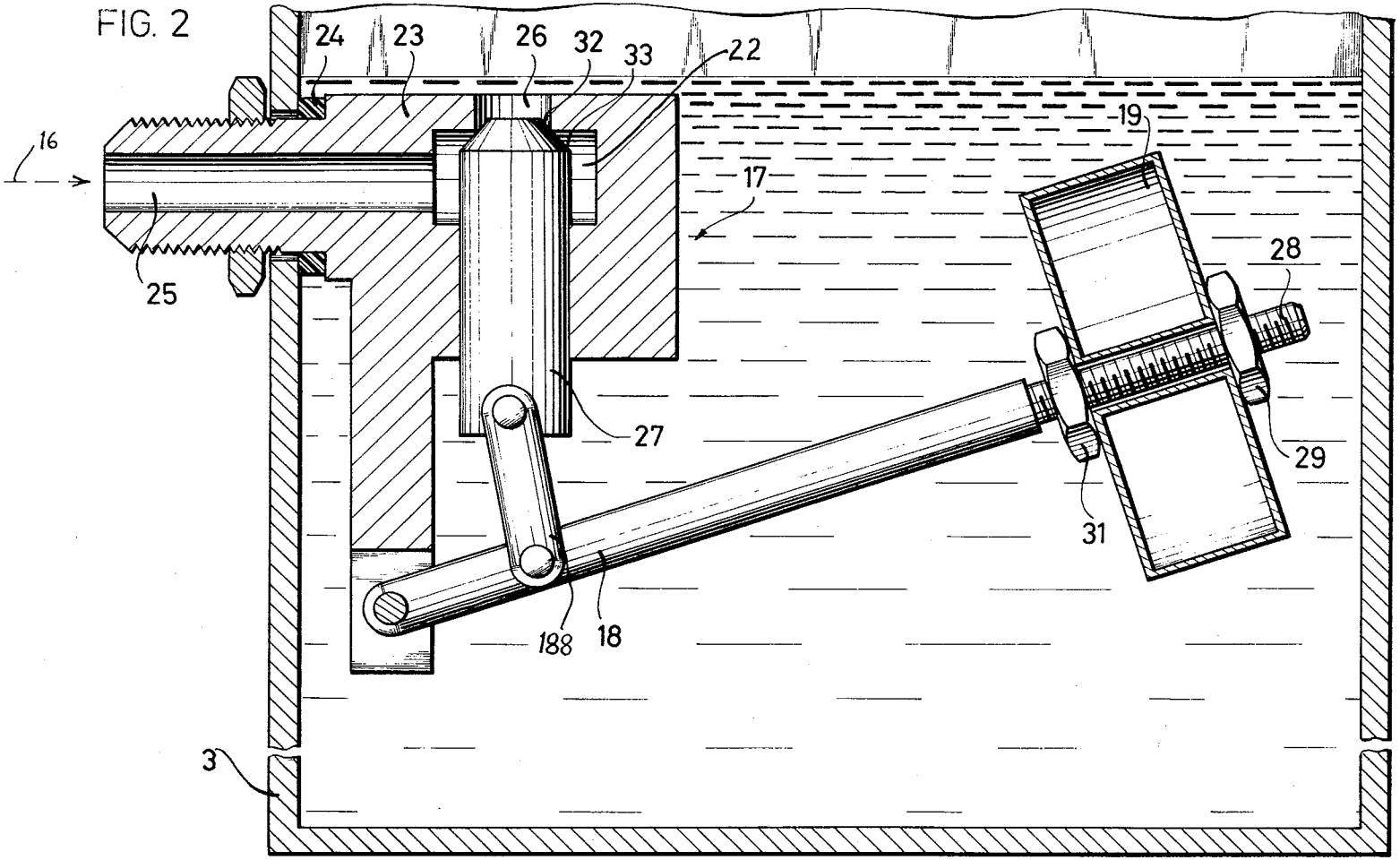
FIG. 2 is an enlarged detail, with parts broken away, of the hydraulic fluid level regulating float valve shown in FIG. 1.

Parallel to the first control line 7, is a second control line 16. The second control line 16 is connected downstream of the discharge port 88 of the pressure regulating valve 8 to a fluid level regulating float valve 17. By way of a lever arm 18 and connecting link 188 the regulating float valve 17 is connected to a float 19 which, as a function of the hydraulic fluid level 21 in the fluid reservoir 3, controls the fluid level regulating float valve 17. In FIGS. 1 and 2 the regulating float valve 17 is shown in a closed position. Upon a lowering of the fluid level in the reservoir 3 the float 19 drops, and by means of the lever arm 18 and connecting link 188, the regulating float valve 17 is moved to an open position, thus connecting the second control line 16 to the interior of the fluid reservoir 3. A relief line 22 branches from the control line 16, so that in cases like those to be described later on, the regulating float valve 17, by means of the control pressure in the control line 16, can also be moved to an open position.

The operating characteristics of the hydraulic control device, according to the invention, will now be described.

Normally, in the position shown in FIG. 1, the hydraulic pump delivers hydraulic fluid drawn from the fluid reservoir 3, by means of the fluid intake or suction line 2, into the fluid output or pressure line 4. Fluid enters port 39 and is directed by the spool valve means 55 into discharge port 41 which is connected to the feed line 9 of the hydraulic actuator or consumer unit 11. A portion of the fluid in line 4 is also directed to the first control line 7 and the restrictor valve 8 to establish the pressure in line 77 and shift the spool valve means 55, against the force of the spring 6, to the leftward position shown in FIG. 1.

Let us assume that a line failure occurs in the line 9 of the hydraulic circuit of the consumer unit 11, so that the hydraulic fluid escapes through the break in the line 9. In such a case the hydraulic fluid not only contaminates the surrounding area, but there is a considerable danger of the fluid in the reservoir dropping below a level where the satisfactory supply to the other consumer units of the system, for instance the hydraulic steering device, could no longer be assured. However, hydraulic consumers of such priority must be supplied with a sufficient volume of hydraulic fluid in all circumstances. To prevent the hydraulic fluid from escaping through the leak in the consumer circuit, the short-circuit line 14 is used to short-circuit the pressure side 4 of the hydraulic pump with the suction side 2. The above is accomplished as will now be explained.

As the fluid level drops in the reservoir 3, the float 19 also drops to a level where the lever arm 18 and connecting link 188 pulls the float valve 17 from the seat 26 to an open position. Now the pressure and fluid in the control line 16 can escape into the fluid reservoir 3. Simultaneously, the pressure in the first control line 77 drops, too, so that the spool means 55 of the pressure relief valve 5 is shifted to the second switch position by the force of the spring 6. In this second switch position, the adjustable pressure regulating valve 13 directs hydraulic fluid from the pressure line 4 through port 43 into the short circuit line 14 which is connected into the intake or suction line 2 of the hydraulic pump 1. This way the leaking consumer circuit 9 is separated from the fluid supply circuit 4 and further fluid losses are thus eliminated. Furthermore, the hydraulic pump 1 will not be operated without any hydraulic fluid, thus preventing cavitation in the pump due to a lack of hydraulic fluid in the reservoir.

The hydraulic control device renders possible the simultaneous use of the regulating float valve 17 as a pressure relief valve by connecting one end of the regulating float valve 17 to the second control line 16 via a relief line or chamber 22. In case a high peak pressure develops in the hydraulic system and incident thereto in the control line 16, the regulating float valve 17, by means of the relief line or chamber 22, is also shifted to an open position against the buoyant force of the fluid acting upon the float 19. In this case it is a basic requirement that the fluid pressure in the control line 16 should exceed the buoyant force of the liquid acting upon the float 19. Apart from a temporary reduction of the peak-pressure it is also possible to diminish overloading conditions lasting over prolonged periods of time, in which case the regulating float valve 17 is kept open for a longer period, thus causing the pressure in the control line 77 to drop and also causing the spool 55 in the pressure relief valve 5 to be moved to the second switch position.

FIG. 2 shows the design of the regulating float or ball cock valve 17. The drawing shows that by means of a seal 24 the valve housing 23 of the regulating float valve 17 is flanged onto the wall of the reservoir 3 in an impervious manner. The valve housing 23 has an inlet port 25 connected to the control line 16 as well as a cylindrical bore or valve seat 26 for seating the servo-valve spool 27, provided the fluid level in the reservoir 3 is sufficiently high. The cylindrical bore or valve seat 26 is connected to the interior of the fluid reservoir 3. By way of the lever arm 18 and the connecting link 188, the one end of the servo-valve spool 27 is connected to the float member 19. The float member 19, by means of two nuts 29 and 31 is fitted in an adjustable manner on a threaded rod 28. This way the seating force of the servo-valve spool 27 can be adjusted for different levels of fluid in the reservoir 3. The servo-valve spool 27 has a tapered control surface 32 sitting in a sealing manner against the peripheral edge of the cylindrical bore or valve seat 26. While part of the tapered control surface 32 extends into the reservoir, a part is located below the valve seat 26 and is in communication with the relief line or chamber 22 and the inlet hole 25 and thus also with the control line 16. The nuts 29 and 31 provide the servo-valve spool 27 with adjustability to function as a regulating float valve, and the tapered control surface 32 and annular face 33 provide the function of a pressure relief valve as described in detail above.

DESCRIPTION OF THE MODIFIED EMBODIMENT

The hydraulic control device pictured in FIG. 3 corresponds essentially with that pictured in FIG. 1. Where identical structural components are used, they are marked by identical reference numbes. In the modified embodiment shown in FIG. 3 the pressure relief valve 50 has a valve housing 34 and a servo-valve spool 36 arranged axially movable in a bore 35 provided in the valve housing 34. At one end of the valve housing 34 there is a first control chamber 37. A second control chamber 38 is provided at the opposite end. The valve housing 34 also has the intake port 39, the discharge port 41 leading to the feed line 9, and two additional ports 42 and 43.

The servo-valve spool 36 has three control surfaces, a first control face 44, a second or center control face 45, and a third control face 46. To relieve the second control chamber 38 and simultaneously to achieve an attenuation during the movement of the servo-valve spool 36, a bore hole 47 extends in axial direction through the third control surface 46, whereby said bore hole 47 connects the second control chamber 38 with the port 42. At the opposite side of the valve housing 34 an axially adjustable stop pin 48 is arranged which can be used to limit the displacement of the valve spool 36. By appropriate adjustment of the stop pin 48 and after contact of the detent-like first control face 44 with the stop pin 48 a certain axial position of the valve spool 36 is achieved which results in a certain throttle cross section being obtained in the intake port 39 between the second or center control face 45 and the valve housing 34. The pressure head produced by this setting of the pressure regulating valve must be such that after short-circuiting the hydraulic pump 1 via the short-circuit line 14 in the vicinity of the second or center control face 45 and the left-hand section of the valve housing 34, and that after the regulating float valve 17 is closed again via the duct-like control line 7 and the pressure regulating valve 8 in the first control chamber, a control pressure can build up which is stronger than the resilience of the compression spring 6. This guarantees that the entire hydraulic system can again be started up; meaning, it is guaranteed that the valve spool 36 can return from its closed position, as indicated in FIG. 3 by dot-dash lines, to its open position, as shown by solid lines in FIG. 4. The valve housing 34 can also be designed as a separate element. However, expediently it is flanged directly onto the hydraulic pump 1.

The embodiments of the invention in which an exclusive property of priviledge is claimed are defined as follows:

1. A hydraulic power system of the type comprising a hydraulic power consumer unit, a hydraulic power source having fluid delivery and suction sides, a fluid reservoir including fluid therein at a predetermined system operational level, a float valve positioned in the reservoir and having a plunger valve linked by a lever arm to a float member, the plunger valve having a closed position when the fluid in the reservoir is at the system operational level and an open position when the fluid in the reservoir drops below the system operational level, a suction conduit having an open end positioned in the fluid in the reservoir below the operational level thereof and an opposite end connected to the suction side of the source, CHARACTERIZED BY:

a two position fluid flow diverter valve having a fluid inlet line connected to the fluid delivery side of the source and a fluid feed line connected to the unit and a fluid short circuit means connected to the suction side of the source, the diverter valve having an axially moveable valve spool means acted upon at one side by a spring and acted upon at an opposite side by fluid pressure in a chamber in the diverter valve whereby when the fluid pressure in the chamber exceeds the force of the spring it shifts the valve spool means to the first position of the diverter valve against the force of the spring and connects the inlet line to the fluid feed line and when the force of the spring exceeds the pressure of the fluid in the chamber it shifts the valve spool means to the second position of the diverter valve and connects the inlet line to the fluid short circuit means;

an axially adjustable stop means in the diverter valve chamber for limiting the axial displacement of the valve spool means in the second position of the diverter valve thereby controlling the rate of fluid flow from the inlet line to the short circuit means in said second position of the diverter valve;

a first control line including fluid flow restriction means therein restrictively connecting the delivery side of the source to the diverter valve chamber; and a second control line connecting the diverter valve chamber to a float valve chamber; the plunger valve closing the float valve chamber from communication with the reservoir in the closed position of the float valve and opening communication in the open position thereof whereby the diverter valve chamber is depressurized and the valve spool means is shifted by the spring to the second position of the diverter valve;

the valve spool means having three control surfaces arranged at axially spaced-apart intervals to each other, one control surface arranged on the spring side of the diverter valve and having an opening therethrough connecting the spring side to the suction side of the source, a second control surface arranged on the chamber side of the diverter valve and interacting with the stop means, and the third control surface arranged between the other two control surfaces controlling fluid flow at the delivery and suction sides of the source.

* * * * *